US007547218B2

(12) United States Patent
Hiew et al.

(10) Patent No.: US 7,547,218 B2
(45) Date of Patent: Jun. 16, 2009

(54) PLUG AND CAP FOR A UNIVERSAL-SERIAL-BUS (USB) DEVICE

(75) Inventors: Siew Sin Hiew, San Jose, CA (US); Jim Ni, San Jose, CA (US); Abraham C. Ma, Fremont, CA (US); David Nguyen, San Jose, CA (US)

(73) Assignee: Super Talent Electronics Inc., San Jose, CA (US)

( * ) Notice: Subject to any disclaimer, the term of this patent is extended or adjusted under 35 U.S.C. 154(b) by 56 days.

(21) Appl. No.: 11/901,604

(22) Filed: Sep. 17, 2007

(65) Prior Publication Data

US 2008/0064271 A1 Mar. 13, 2008

Related U.S. Application Data

(60) Continuation-in-part of application No. 11/697,618, filed on Apr. 6, 2007, now Pat. No. 7,347,736, which is a division of application No. 11/257,575, filed on Oct. 24, 2005, now Pat. No. 7,249,978, and a division of application No. 11/309,847, filed on Oct. 12, 2006.

(51) Int. Cl.
*H01R 13/44* (2006.01)

(52) U.S. Cl. ..... 439/135; 439/892

(58) Field of Classification Search ..... 439/135, 439/892, 136, 149

See application file for complete search history.

(56) References Cited

U.S. PATENT DOCUMENTS 4,134,635 A * 1/1979 Roche ..... 439/135
4,902,238 A * 2/1990 Iacobucci ..... 439/135
5,623,552 A 4/1997 Lane
5,630,419 A * 5/1997 Ranalletta ..... 600/459
5,907,856 A 5/1999 Estakhri et al.
5,959,541 A 9/1999 DiMaria et al.
6,000,006 A 12/1999 Bruce et al.
6,012,636 A 1/2000 Smith
6,065,981 A * 5/2000 Sopotnick et al. ..... 439/135
6,069,920 A 5/2000 Schulz et al.
6,081,858 A 6/2000 Abudayyeh et al.
6,125,192 A 9/2000 Bjorn et al.
6,142,805 A * 11/2000 Gray et al. ..... 439/206
6,193,152 B1 2/2001 Fernando et al.
6,202,138 B1 3/2001 Estakhri et al.
6,230,233 B1 5/2001 Lofgren et al.
6,275,894 B1 8/2001 Kuo et al.

(Continued)

*Primary Examiner*—Gary F. Paumen
(74) *Attorney, Agent, or Firm*—Blakely Sokoloff Taylor & Zafman LLP

(57) ABSTRACT

Embodiments of a plug and cap of a Universal-Serial-Bus (USB) device have been presented. In one embodiment, a USB device includes a main body, a piece of string, and a cap. The main body has a printed circuit board assembly (PCBA) and a casing, wherein the PCBA is partially housed in the casing, and the PCBA further includes a USB connector protruding out of the casing at a first end of the casing. The piece of string is coupled to the main body and the cap. The cap is detachably coupled to the first end of the casing of the main body to cover the USB connector, wherein the cap remains indirectly coupled to the casing via the piece of string when the cap is detached from the first end of the casing to expose the USB connector.

17 Claims, 9 Drawing Sheets

U.S. PATENT DOCUMENTS 6,321,478 B1 11/2001 Klebes
6,456,500 B1 * 9/2002 Chen ..... 361/752
6,547,130 B1 4/2003 Shen
6,636,929 B1 10/2003 Frantz et al.
6,676,422 B1 * 1/2004 Baker et al. ..... 439/135
6,718,407 B2 4/2004 Martwick
6,880,024 B2 4/2005 Chen et al.
7,103,765 B2 9/2006 Chen
7,153,148 B2 * 12/2006 Chen et al. ..... 439/141
7,249,978 B1 7/2007 Ni
7,257,714 B1 8/2007 Shen
7,329,153 B2 * 2/2008 Lin et al. ..... 439/660
7,341,464 B2 * 3/2008 Cuellar et al. ..... 439/135
7,416,424 B1 * 8/2008 Deckman ..... 439/135
7,442,077 B2 * 10/2008 Peress et al. ..... 439/505
2001/0043174 A1 11/2001 Jacobsen et al.
2002/0166023 A1 11/2002 Nolan et al.
2003/0046510 A1 3/2003 North
2003/0163656 A1 8/2003 Ganton
2003/0207601 A1 * 11/2003 Adachi ..... 439/135
2004/0148482 A1 7/2004 Grundy et al.
2004/0255054 A1 12/2004 Pua et al.
2005/0102444 A1 5/2005 Cruz
2005/0120146 A1 6/2005 Chen et al.
2005/0160213 A1 7/2005 Chen
2005/0193161 A1 9/2005 Lee et al.
2005/0246243 A1 11/2005 Adams et al.
2005/0268082 A1 12/2005 Poisner
2006/0010737 A1 * 1/2006 Lee ..... 40/406
2006/0023433 A1 * 2/2006 Lin ..... 361/752
2006/0065743 A1 3/2006 Fruhauf
2006/0075174 A1 4/2006 Vuong
2006/0106962 A1 5/2006 Woodbridge et al.
2006/0161725 A1 7/2006 Lee et al.
2006/0206702 A1 9/2006 Fausak
2006/0242395 A1 10/2006 Fausak
2006/0276062 A1 * 12/2006 Lin et al. ..... 439/79
2007/0094489 A1 4/2007 Ota et al.
2007/0111583 A1 * 5/2007 Cuellar et al. ..... 439/353
2007/0112067 A1 5/2007 Oh et al.
2007/0113267 A1 5/2007 Iwanski et al.
2007/0130436 A1 6/2007 Shen
2007/0184685 A1 * 8/2007 Hsueh et al. ..... 439/76.1
2008/0305650 A1 * 12/2008 Chen ..... 439/62

* cited by examiner

PLUG AND CAP FOR A UNIVERSAL-SERIAL-BUS (USB) DEVICE

RELATED APPLICATIONS

This is a continuation-in-part application of application Ser. No. 11/697,618, filed Apr. 6, 2007 now U.S. Pat. No. 7,347,736, which is a divisional application of application Ser. No. 11/257,575, now U.S. Pat. No. 7,249,978, filed Oct. 24, 2005, and application Ser. No. 11/309,847, filed Oct. 12, 2006, which are incorporated by reference.

TECHNICAL FIELD

The present invention relates to portable electronic devices, and more particularly, to portable electronic devices having a Universal-Serial-Bus (USB) connector.

BACKGROUND

With the wide-spread promulgation of USB standard, portable electronic devices having a connector complying with the USB standard have been gaining popularity in the market because of the ease of use and low cost of such connectors. Typically, a portable electronic device (e.g., a flash memory card, a digital camera, etc.) has a male USB connector, which may be plugged into a female USB socket provided by other portable or non-portable electronic devices, such as personal computers (PCs), personal digital assistants (PDAs), game consoles, etc. The male USB connector may also be simply referred to as a USB connector. A variety of external package case types have been developed for these portable electronic devices to protect their USB connectors. For example, a USB flash memory card typically uses surface mount technology (SMT) to assemble a printed circuit board assembly (PCBA) with an external package case for protecting the electronic components on the PCBA as well as to add esthetic value to the USB flash memory card. The external package case of most conventional USB memory cards (also referred to as USB memory sticks) generally has a protective cap detachably coupled to the main body of the package case. The protective cap (also simply referred to as the cap) is utilized to cover, and hence, to protect a male USB connector (or simply referred to as a USB connector) from mechanical and/or electrical damages. The protective cap is typically detached from the main body when the conventional USB memory card is in use, thus making it easy to lose the cap as users of the USB memory card often forget putting the cap back onto the USB memory card.

SUMMARY

Embodiments of a plug and cap of a Universal-Serial-Bus (USB) device have been presented. In one embodiment, a USB device includes a main body, a piece of string, and a cap. The main body has a printed circuit board assembly (PCBA) and a casing, wherein the PCBA is partially housed in the casing, and the PCBA further includes a USB connector protruding out of the casing at a first end of the casing. The piece of string is coupled to the main body and the cap. The cap is detachably coupled to the first end of the casing of the main body to cover the USB connector, wherein the cap remains indirectly coupled to the casing via the piece of string when the cap is detached from the first end of the casing to expose the USB connector.

Other features of the present invention will be apparent from the accompanying drawings and from the detailed description that follows.

BRIEF DESCRIPTION OF THE DRAWINGS

The present invention will be understood more fully from the detailed description that follows and from the accompanying drawings, which however, should not be taken to limit the appended claims to the specific embodiments shown, but are for explanation and understanding only.

DETAILED DESCRIPTION

In the following description, numerous specific details are set forth. However, it is understood that embodiments of the invention may be practiced without these specific details. In other instances, well-known components, structures, and techniques have not been shown in detail in order not to obscure the understanding of this description.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification do not necessarily all refer to the same embodiment. The term "to couple" as used herein may include both to directly couple and to indirectly couple through one or more intervening components. As used herein, the terms "upper," "upwards," "lower," "downward," "top," "bottom," "left," and "right" are intended to provide relative positions for purposes of description, not to designate an absolute frame of reference.

The technique disclosed herein is generally applicable to Universal-Serial-Bus (USB) devices. A USB device as used herein broadly refers to a portable electronic device having at least one connector complying with the USB specification.

Some examples of a USB device include a memory stick (e.g., a flash memory stick that may include single-level cell flash memory and/or multi-level cell (MLC) flash memory), a mouse, a joystick, a digital camera, a PDA, a smart phone, etc. The USB connector provides a convenient interface for the USB device to communicatively couple to another electronic device (e.g., a personal computer (PC), a game console, a PDA, etc.).

In one embodiment, a USB device includes a main body, a piece of string, and a cap. The main body has a printed circuit board assembly (PCBA) and a casing, wherein the PCBA is partially housed in the casing, and the PCBA further includes a USB connector protruding out of the casing at a first end of the casing. The piece of string is coupled to the main body and the cap. The cap is detachably coupled to the first end of the casing of the main body to cover the USB connector, wherein the cap remains indirectly coupled to the casing via the piece of string when the cap is detached from the first end of the casing to expose the USB connector.

Figure 1:
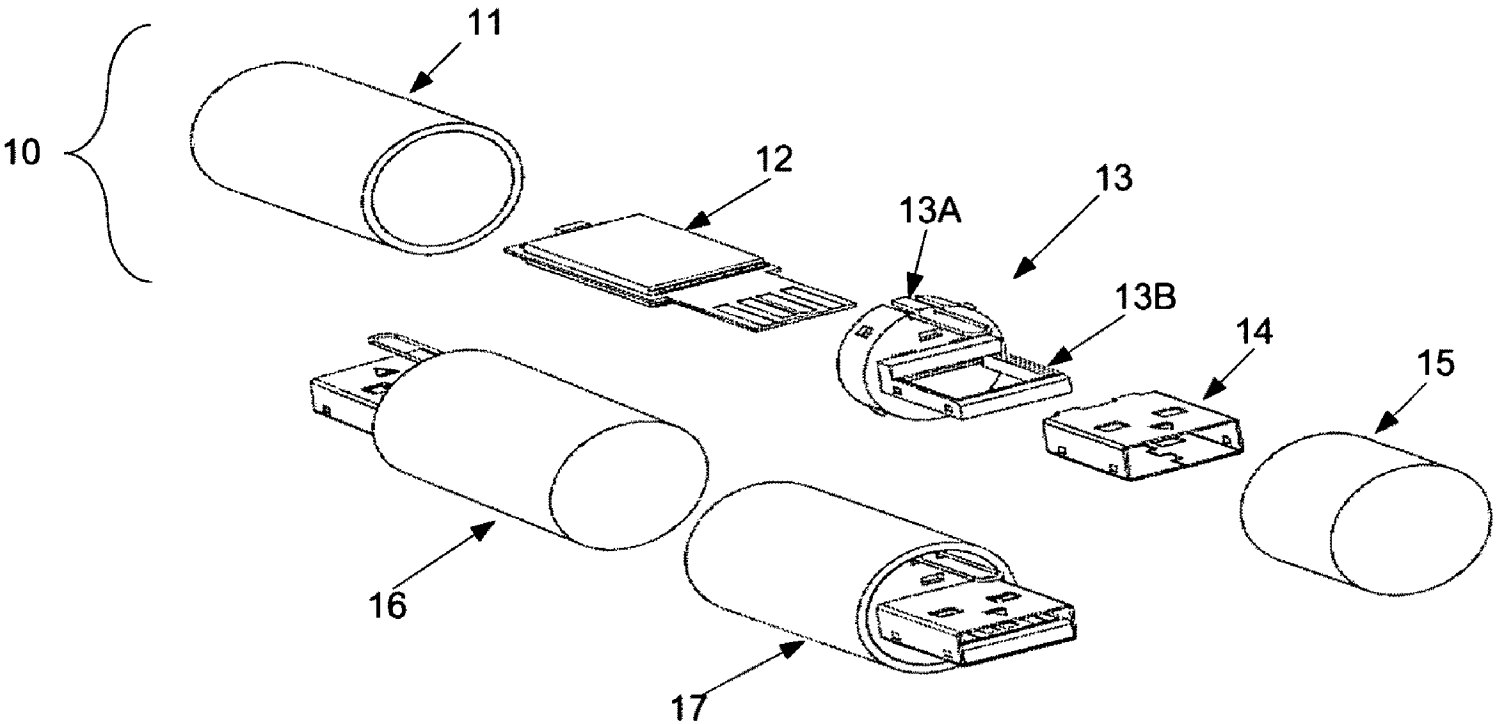
FIG. 1 shows an exploded view of one embodiment of a USB memory card made of flash memory having the external shape of a cylinder.

FIG. 1 shows an exploded view of one embodiment of a USB memory card made of flash memory having the external shape of a cylinder. Although the USB memory card is used as an example herein to illustrate various embodiments of the invention, one should appreciate that the techniques disclosed are applicable to other USB devices (e.g., digital camera, PDA, etc.). Referring to FIG. 1, the USB memory card 10 includes a closed end hollow cylinder main body casing 11, a flash memory printed circuit board assembly (PCBA) 12, a connector plug structure having a connector pins edge frame and rubber band hook 13, a USB contact pin metal casing 14, a cylindrical contact pins cap 15 with closed end and unique design for attaching cap to the main body during usage. FIG. 1 further illustrates a back view 16 and a front view 17 respectively of the assembled USB memory card 10. PCBA 12 of FIG. 1 is the core component piece of the USB flash memory card. Details of some embodiments of the assembly process of the PCBA 12 are described below.

Note that the technique disclosed herein is applicable to USB devices of standard USB thickness and/or reduced (slim) thickness, such as those described in the U.S. patent application Ser. No. 11/697,618, filed Apr. 6, 2007, which is incorporated herein by reference.

Figure 2:
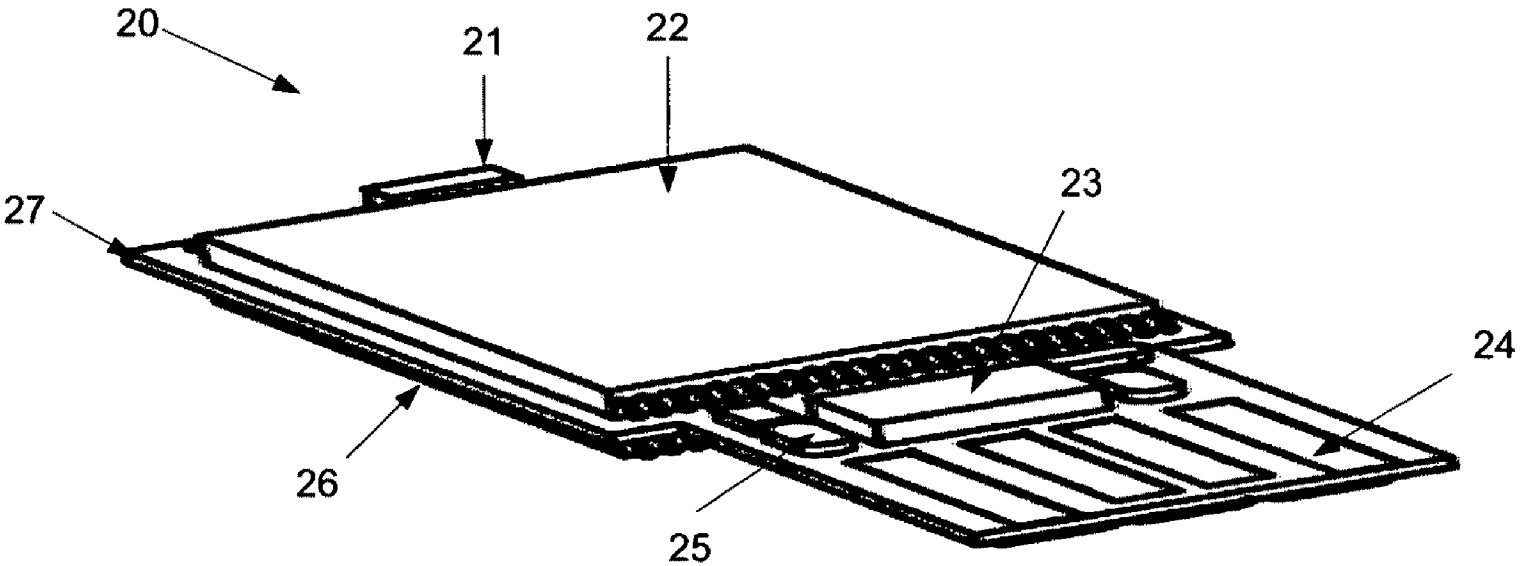
FIG. 2 shows one embodiment of a printed circuit board assembly (PCBA).

Some embodiments of the surface mount technology (SMT) process to build up the PCBA 12 in FIG. 1 are described in details with reference to FIG. 2. FIG. 2 shows one embodiment of a PCBA. In some embodiments, the blank printed circuit board (PCB) [27] in FIG. 2 is available in panel form, which includes 2×8=16 small pieces of PCB that formed the panel 27. Some advantages of grouping a set of small printed circuit boards are improved throughputs and lower manufacturing cost.

In some embodiments, assembly of the USB memory card begins with loading the PCB panel onto a stencil printer to print a lead-free solder on all the exposed contact fingers of the bottom surface of the PCBs on the panel. When the printing process has been completed, the panel is conveyed to a chip mounting machine (also referred to as a chip mounter). All passive components, such as capacitors 25, resistors, oscillator, light emitting diode 21, flash memory chip 22, and controller chip 23, are mounted on the bottom surface of their individual designated positions by a pick-and-place mechanism of the chip mounting machine. After all electronic components have been accurately and properly mounted at the right places, the panel is then conveyed to an infra-red reflow (IR-reflow) oven. The temperature profile and set up of the oven is very critical for the SMT process and thus, it is pre-determined and established during the product development phase.

The IR-reflow oven has five to fifteen temperature zones depending on the model and maker of the IR-reflow oven. In general, the more temperature zones an oven has, the more accurate and better it is for the temperature profile control. In some embodiments, an oven is divided into five zones: a) the preheat zone, b) the ramp up zone, c) the peak/classification temperature zone d) critical (time within 5 degree Celsius of actual peak) temperature zone, and e) ramp down zone. At the peak/classification temperature zone, the lead-free solder is totally melted. The PCB panel is then put through a 10 seconds to 40 seconds of critical temperature zone to allow the molten lead-free solder to spread to the exposed metal surfaces and also to automatically adjust the components' position by the surface tension effect of the molten solder.

After passing through the critical temperature zone, the panel is entering a ramp down zone, where the panel is cooling down and the melted solder is beginning to solidify and bonding the components' pins permanently to the finger pads of the PCB. The SMT process is completed when the panel is removed from the oven and cooled down. The cooled down panel then undergoes a de-panel process, where the panel array matrix of the PCB is singulated into individual printed circuit board assemblies (PCBAs), an example of which is shown FIG. 2. These individual PCBAs are then subjected to electrical tests to screen out the defective ones, such as the non-functional ones, those with process induced defects, etc. The good PCBAs are essentially USB memory cards without casing. Details of some embodiment of assembling the PCBA and a casing are discussed below.

Figure 3:
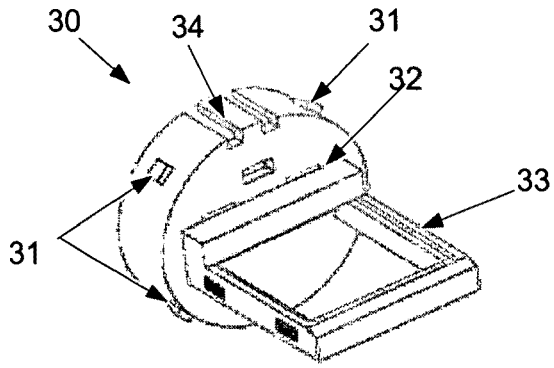
FIG. 3 shows one embodiment of a connector plug.

FIG. 3 shows one embodiment of a pre-molded plastic piece called connector plug 30. The connector plug 30 may be made of various kinds of durable and non-conductive materials, such as plastic. In some embodiments, there are four notches 31 on the rim of the connector plug, where three of the four notches are visible in FIG. 3, two slots 32 for a connector metal piece to anchor on later, and a rectangular frame [33] having a step (which substantially matches the thickness of the PCB) for the PCBA to snugly sit on. Furthermore, there are two slits on the connector plug rim that form a pole 34 to allows an elastic string loop (such as a rubber band) to anchor onto. Note that the numbers of notches 31 and slots 32 may vary in different embodiments.

Figure 4:
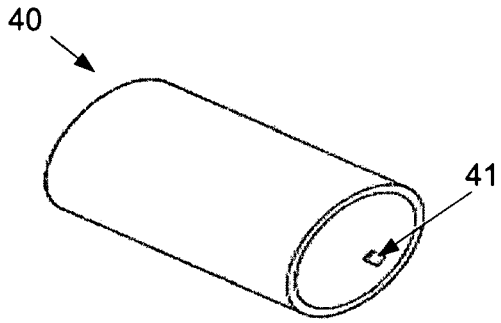
FIG. 4 shows one embodiment of a main body casing of a cylindrical USB memory card.

FIG. 4 shows one embodiment of a main body casing 40 of the cylindrical USB memory card. This is a closed end hollow cylindrical case 40 with four recesses or mortises 41 (one visible in this drawing view) substantially evenly distributed on the inner wall near the edge of the opening of the cylindrical casing 40. The recesses or mortises 41 allow a connector plug (such as the connector plug 30 in FIG. 3) to snaps on the cylindrical casing 40 and lock in place. Although the current example includes a cylindrical case, other embodiments may include cases of different shapes, such as a rectangular case.

Figure 5:
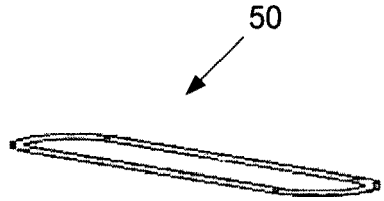
FIG. 5 is one embodiment of a piece of elastic string loop usable in some embodiments of the invention.

FIG. 5 is a piece of elastic string loop, such as a rubber band or any elastic and durable string configured into a loop, that can withstand many repetitions of stretching and abuses. For example, a rubber band or elastic string used in some embodiments is made of material that exceeds the standard set forth in Federal Specification AA-131-B.

Figure 6:
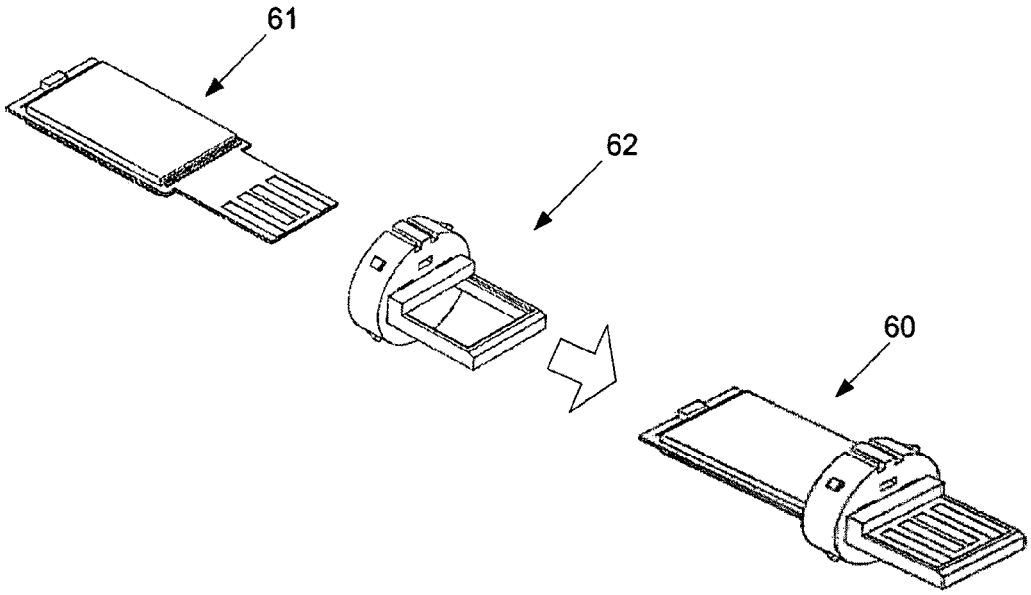
FIG. 6 illustrates one embodiment of a process to assemble a PCBA and a connector plug.

FIG. 6 illustrates one embodiment of a process to assemble a PCBA and a connector plug. A PCBA 61 is inserted through a slot opening of the connector plug 62 with the contact fingers protruding out from the rim of the connector plug and sitting snugly in the lower step of the rectangular frame such that all three edges (narrow section of PCB) of the contact pins surrounded and protected. The sub-assembly is referred to as a PCBA-connector plug sub-assembly 60, which is also shown in FIG. 6.

Figure 7:
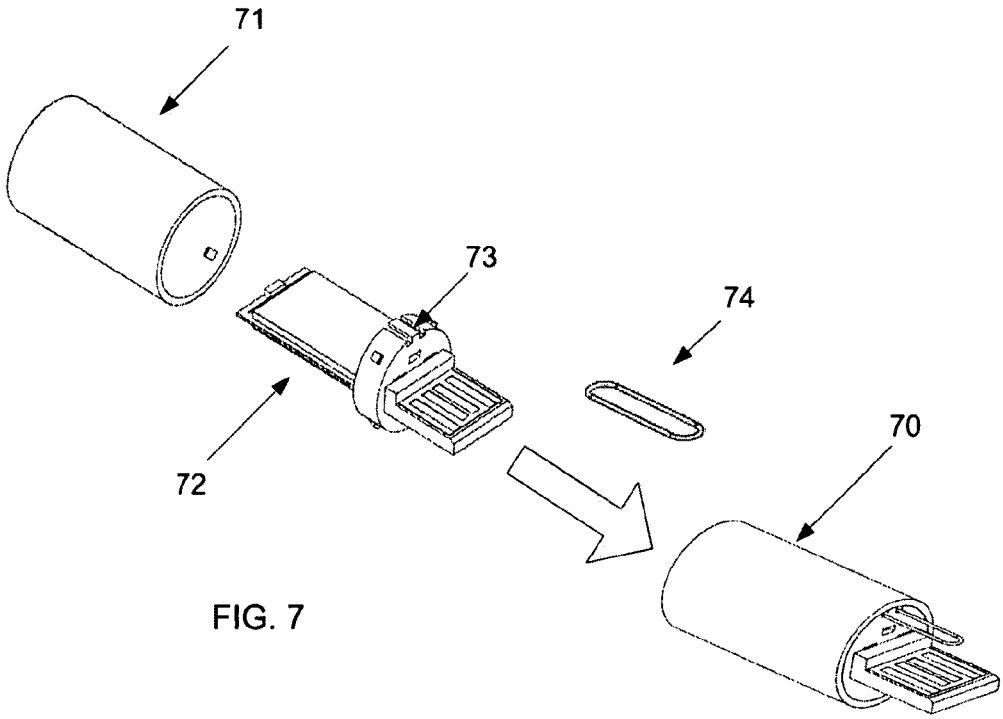
FIG. 7 illustrates one embodiment of a process to assemble a main body casing and a PCBA-connector plug assembly.

FIG. 7 illustrates one embodiment of a process to assemble a main body casing and a PCBA-connector plug assembly. The elastic string loop 74 is placed and hooked on the pole of the connector plug rim 73. Then the PCBA-Connector Plug sub-assembly 72 is inserted into the main body casing 71. The four notches on the rim of the connector plug snap into the mortises of the inner surface of the main body casing 71 as the PCBA-connector plug sub-assembly is inserted into the main body casing 71. The new sub-assembly 70 resulted is shown in FIG. 7.

Figure 8:
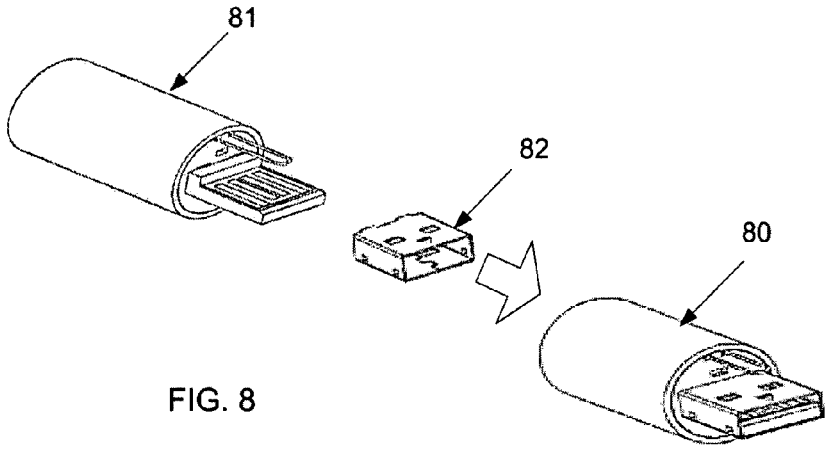
FIG. 8 illustrates one embodiment of a process to snap on a connector metal case to the sub-assembly 70 from FIG. 7.

FIG. 8 illustrates one embodiment of a process to snap on a connector metal case to the sub-assembly 70 in FIG. 7. The connector metal case 82 is snapped onto the slots on the connector plug of the sub-assembly 81, which are designed for this metal case 82 to snap and anchor on. The completed piece is a functional USB memory card 80, without any cap. Details of some embodiments of assembling a cap with this main body are discussed below.

Figure 9:
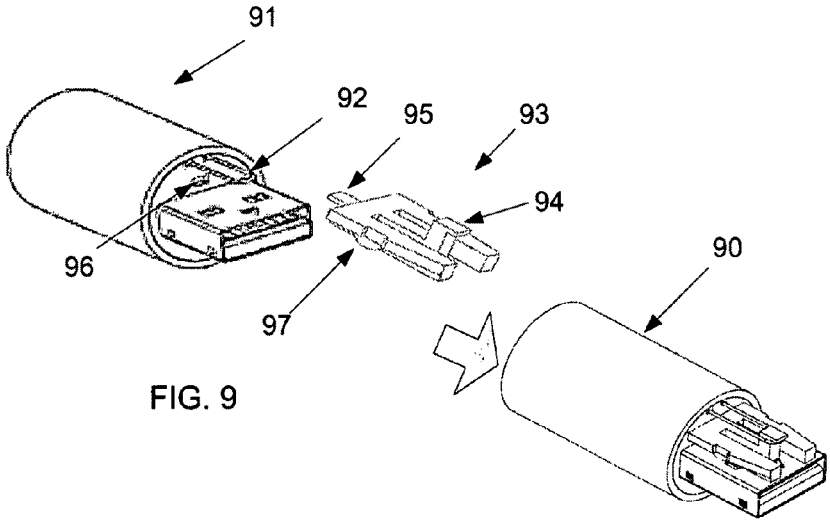
FIG. 9 illustrates one embodiment of a process to assemble a cap with the USB memory card 80 from FIG. 8.

FIG. 9 illustrates one embodiment of a process to assemble a cap with the USB memory card 80 in FIG. 8. In some embodiments, the cap assembly includes a uniquely designed anchoring structure 93, which is also referred to as a rubber band hook because of its function, or a tuning fork like structure because of its shape. The anchoring structure is also made of a durable non-conductive material, such as plastic. One end of the rubber band 92 of sub-assembly 91 is looped over the hook 94 of the anchoring structure 93. A protruding end tab 95 of the anchoring structure 93 is inserted into the slot 96 on the connector plug plate. The assembled view 90 of the USB memory card 91 and the anchoring structure 93 is shown in FIG. 9.

Figure 10A:
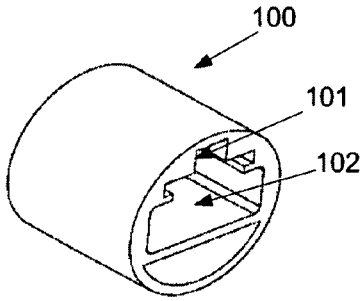
FIG. 10A illustrates one embodiment of a cap.

Viewing the cap 100 from the open end as shown in FIG. 10A, cavity 101 within the cap 100 is the cavity for housing the anchoring structure 93 in FIG. 9 and cavity 102 is the cavity for housing the USB connector. In some embodiments, the cap 100 is of approximately ⅓ of the overall length of the completed cylindrical USB memory card structure.

Figure 10B:
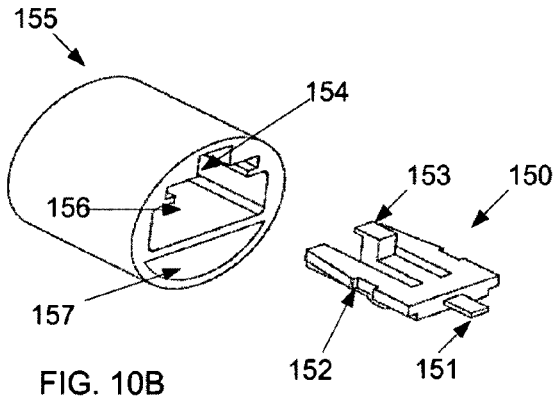
FIG. 10B illustrates one embodiment of the cap with the anchoring structure.

FIG. 10B illustrates one embodiment of the cap with the anchoring structure. A pole stands at about 90 degree perpendicular to the end tip of middle prong of the anchoring structure 150 has a slight protruded flat top 153 to serve as a hook for the string loop (e.g., a rubber band). A recess (a.k.a. mortise) 152 at both sides of the anchoring structure 150 snap with the notch at the inner side walls of the cavity 154 of the cap 155 for the anchoring structure 150. A pulling tab 151 of the anchoring structure 150 is provided for pulling out the anchoring structure 150 when replacing the string loop.

In some embodiments, the close end cylindrical cap is with molded to define several cavities, including an upper cavity 154 to hold the anchoring structure 150. The inner side walls have one or more notches to snap with the recess of the anchoring structure 150. A middle cavity 156 is provided to house and to protect the USB connector head of the USB memory card. A lower D-shape cavity 157 is dug out to save plastic molding material and also to add esthetic appeal to the overall structure.

Figure 11:
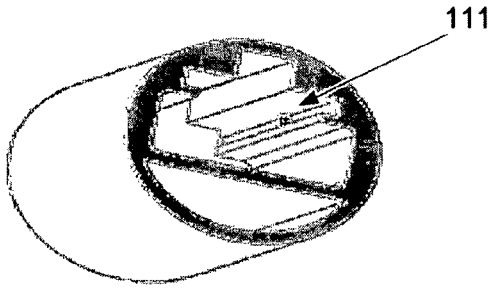
FIG. 11 shows one embodiment of the cap.

FIG. 11 shows one embodiment of the cap. There are two notches 111 on the inner side walls of the rubber band hook cavity slot, one of which is visible as shown in FIG. 11. The recess 97 on both sides of plastic anchoring structure 95 shown in FIG. 9 may snap-on and mate with the notches 111 in order to lock the string (e.g., a rubber band) in a substantially fixed place.

Figure 12:
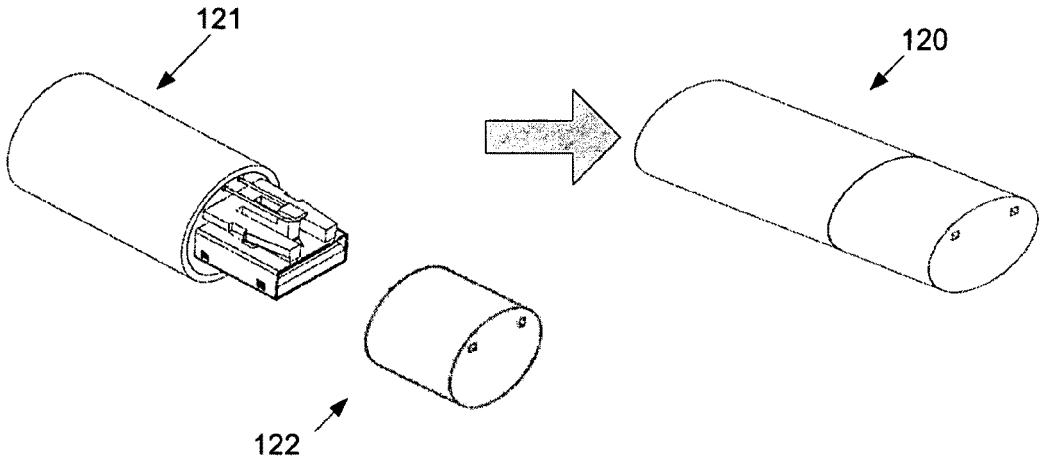
FIG. 12 shows one embodiment of an assembled USB memory card.

As illustrated in FIG. 12, the whole cylindrical USB memory card process is completed when the cap 122 is capped on the sub-assembly main body 121. The external shape of the final completed product is shown as 120 in FIG. 12.

Figure 13:
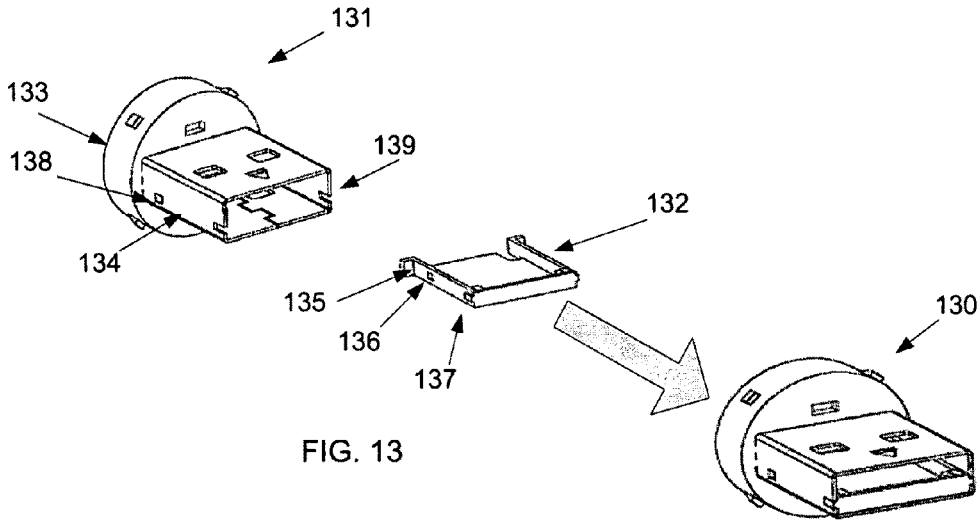
FIG. 13 shows an alternative embodiment of a connector plug.

FIG. 13 shows an alternative embodiment of the connector plug 131, which has a metal connector 134 over-molded into the connector plug structure 133. The rectangular frame substrate 132 is inserted into the metal connector 134 from the front side. The tail end notches 135 may slide through and beyond the chamber of the metal connector 134. These end notches 135 may hook onto the connector plug plate once its slide past the metal connector chamber. Notches 136 and 137 on both sides of the substrate 132 may snap into the recesses 138 and 139 of metal connector 134. The substrate 132 then sits securely and firmly in the chamber of the metal connector as shown in the alternative connector plug 130. The process of assembling with the alternative connector plug is substantially the same as the process described above, except that the snap-on process of the metal connector as illustrated in FIG. 8 is not necessary. The assembled final USB memory card with the alternative connector plug 130 is substantially similar to the assembled USB memory 120 in FIG. 12.

Figure 14:
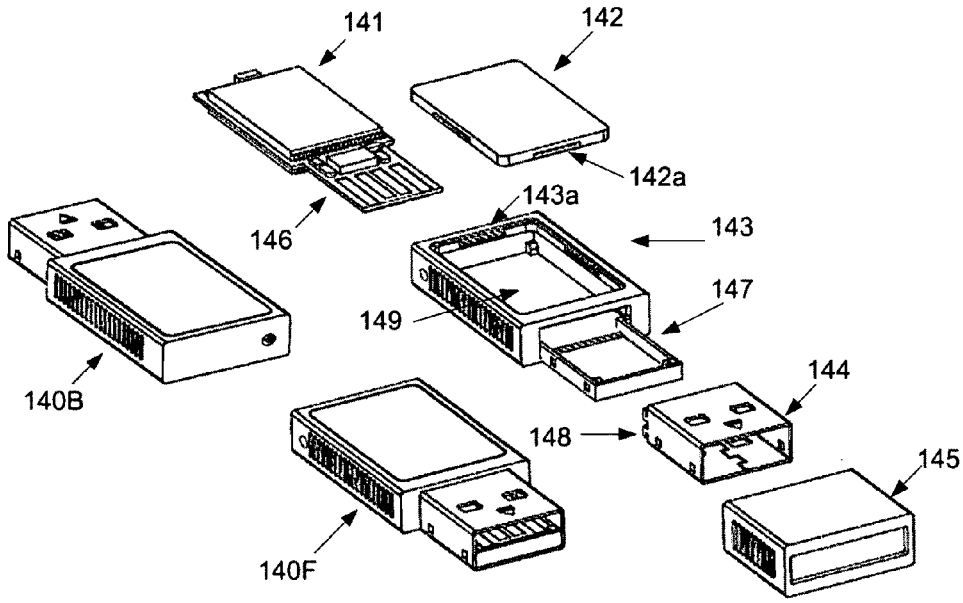
FIG. 14 shows an alternative embodiment of a USB memory card.

FIG. 14 below shows an alternative way to package and process USB memory cards using snap-on to seal the top piece 142 to the bottom piece 143. The PCBA 141 is manufactured using surface mount technology (SMT) process as described above with reference to FIG. 2. Then the PCBA 141 is inserted into the pre-molded plastic main body casing 143 with the connector pins PCB region 146 protruding out from the wider part of the main body casing and sit snugly in the lower step of the rectangular frame substrate 147 with all three edges (narrow section of PCB) of the contact pins surrounded and protected.

In some embodiments, the connector PCB head with the frame 147 is then inserted into USB metal case 144. At the rear end of the metal case 144, there is a pair of finger hooks 148 at each side of the case 144. These finger hooks 148 are snapped into the open slots of the main body case 143.

The top main opening (a.k.a. cavity) 149 may be snapped closed by a plastic cover 142. This plastic cover 142 has a strip of tenon (a.k.a. notch) 142*a* on each of the four edges. These tenons may snap onto the mortises (a.k.a. recess) 143*a* at the inner side wall edges of the main body 143. A back side view 140B and a front side view 140F of the finished product is shown in FIG. 14. The cap 145 is a protective cap for the USB connector head.

The technique of securing an elastic string configured into a loop to the main body 143 with an anchoring structure may be applied to the alternative USB memory card shown in FIG. 14. The cap 145 may be designed with a cavity to receive the anchoring structure and notches on the inner wall of the cap 145 to snap on and mate with recesses of the anchoring structure.

Figure 15:
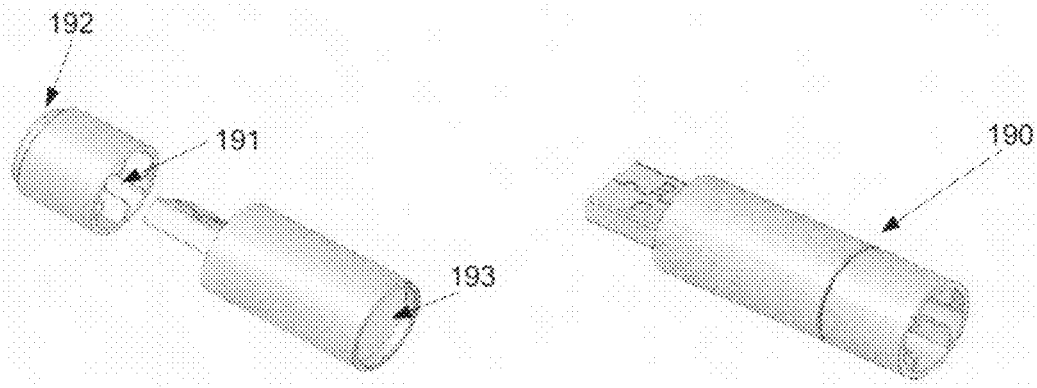
FIG. 15 shows an alternative embodiment of a USB memory card.

FIG. 15 shows an alternative embodiment of a USB memory card. The USB memory card includes a close end cylindrical cap 192 and a main body casing 193 with molded cavities designed to fit the cylindrical cap 192. The cap 191 has a smaller diameter cylindrical cap end 192 and the same diameter cylindrical depression 193 is provided at an end of the main body casing to receive the cylindrical cap end 192. The protruded cylinder 192 and cylindrical depression 193 may mate together as shown in 190 to hold the cap 191 temporary while the USB memory card is in used.

Figure 16:
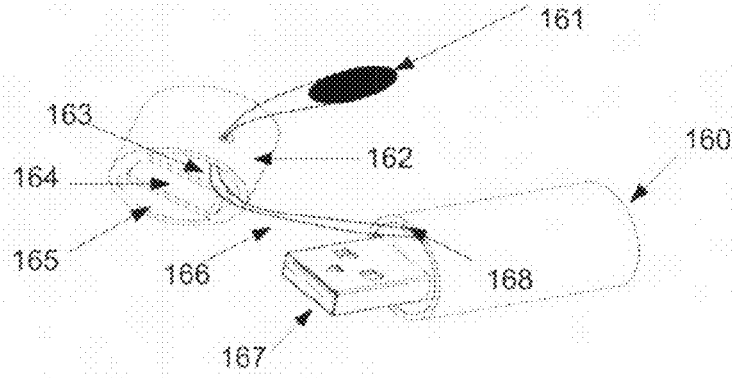
FIG. 16 shows another alternative close end cylindrical cap with molded cavities.

FIG. 16 shows another alternative close end cylindrical cap with molded cavities. Referring to FIG. 16, an upper D-shaped cavity 163 and a lower D-shaped cavity 165 are dug out to create symmetry of the cap. A middle cavity 164 is defined to house the metal connector 167. A hole 162 is opened from the external cap surface into the cavity 163. This hole 162 allows a piece of string or chain 166 to thread through it. An object (e.g., a figurine) 161 of a size larger than the hole may be tied or connected to the end of the string or chain 166 to act as a stopper to prevent the string or chain 166 to slip back through the hole, causing the cap to be separated from the main body of the memory card 160. The other end of the string or chain loop 168 is looped over the pole of the connector plug rim 73 in FIG. 7.

Figure 17:
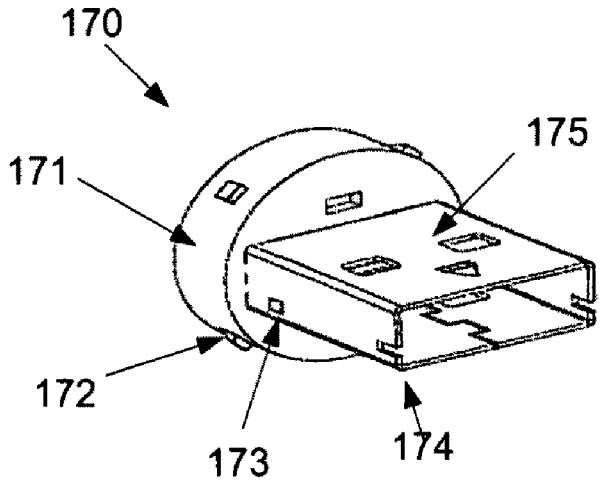
FIG. 17 shows an alternative embodiment of a connector plug.

FIG. 17 shows an alternative embodiment of a connector plug. The assembly process may use an over-molded metal connector 172 coupled to the connector plug 171 to form an alternative connector plug structure 170. The four notches 172 on the rim of connector plug 171 are designed to snap the connector plug structure 170 firmly to the main body cylinder. Two recesses 173 and 174 allow the notches of the rectangular frame substrate to be snapped firmly and securely into the chamber of the metal connector 175.

The foregoing discussion merely describes some exemplary embodiments of the present invention. One skilled in the art will readily recognize from such discussion, the accompanying drawings and the claims that various modifications can be made without departing from the spirit and scope of the invention.

What is claimed is:

1. A Universal-Serial-Bus (USB) device comprising:

a main body including a printed circuit board assembly (PCBA) and a casing, wherein the PCBA is partially housed in the casing, and the PCBA further includes a USB connector protruding out of the casing at a first end of the casing;

a piece of string coupled to the main body; and a cap coupled to the piece of string and further detachably coupled to the first end of the casing of the main body to cover the USB connector, wherein the cap remains indirectly coupled to the casing via the piece of string when the cap is detached from the first end of the casing to expose the USB connector.

2. The USB device of claim 1, wherein the piece of string comprises an elastic string loop, and the USB device further comprises:

an anchoring structure coupled to the cap, the anchoring structure having a first prong, a second prong, a third prong between the first and the second prongs, a pole at an end of the third prong, wherein the pole is substantially perpendicular to the third prong, and the pole includes a protruded flat top to serve as a hook for the elastic string loop.

3. The USB device of claim 2, wherein the first prong defines a first recess on a first side of the first prong and the second prong defines a second recess on a second side of the second prong, wherein the cap has an inner wall defining a first cavity to receive the anchoring structure and defining a plurality of notches to mate with the first recess and the second recess.

4. The USB device of claim 3, wherein the anchoring structure further comprises a pulling tab for disengaging the anchoring structure from the cap.

5. The USB device of claim 3, wherein the inner wall of the cap further defines a second cavity to house the USB connector when the cap is detachably coupled to the first end of the casing.

6. The USB device of claim 3, further comprising a connector plug including:

a rim coupled to the first end of the casing;

a pole at the rim to anchor the elastic string loop; and a second plurality of notches on the rim to securely couple to a plurality of recesses defined by an inner wall of the casing near the first end of the casing.

7. The USB device of claim 6, wherein the PCBA further comprises a rectangular frame substrate having a third plurality of notches, and the connector plug further comprises a rectangular chamber to house the rectangular frame substrate of the PCBA, the rectangular chamber comprising a left side wall, a right side wall, a top surface, and a bottom surface, each of the left side wall and the right side wall defining two or more recesses to allow the third plurality of notches of the rectangular frame substrate to snap on when the rectangular frame substrate is inserted into the rectangular chamber.

8. The USB device of claim 1, wherein a side wall of the cap defines a hole through which the piece of string is threaded such that a first end of the piece of string is coupled to the casing and a second end of the piece of string is coupled to an object of a size larger than the hole, said object acting as a stopper to prevent the piece of string to slip back through the hole.

9. The USB device of claim 1, wherein the casing comprises a cylindrical casing and the USB connector includes one of a regular USB connector having a standard USB thickness and a slim USB connector having a thickness less than the standard USB thickness.

10. The USB device of claim 1, wherein the casing comprises:

a single molding body piece defining an opening for the PCBA to insert through, wherein the single molding body piece further comprises a bottom and four inner side walls defining a main compartment, wherein each of the four inner side walls defines at least one recess;

a cover piece to cover a top of the main compartment, the cover piece comprising four side walls, each of the four side walls having at least one notch to snap with the at least one recess on each of the four inner side walls of the single molding body piece;

a raised protective frame at the opening of the single molding body piece to house the USB connector of the PCBA, said raised protective frame comprising a left side and a right side, each of the left side and the right side having a notch; and a metal connector having a left side, a right side, a top surface, and a bottom surface to define a rectangular chamber for housing the raised protective frame and the USB connector of the PCBA, each of the left side and the right side defining a hole to allow the notch on each of the left side and the right side of the raised protective frame to snap on, each of the left side and the right side comprising at least one pair of finger hooks to anchor onto the single molding body piece near the opening.

11. The USB device of claim 10, wherein the single molding body piece further comprises a left outer side wall and a right outer side wall, each of the left outer side wall and the right outer side wall having a series of vertical ribs.

12. The USB device of claim 11, wherein each of the left outer side wall and the right outer side wall defines a hole.

13. A method to assemble a Universal Serial Bus (USB) device, the method comprising:

attaching a piece of string to a connector plug;

securing the connector plug to a first end of a casing of a main body of the USB device;

looping the piece of string over an anchoring structure;

detachably coupling a cap to the first end of the main body of the USB device and the anchoring structure such that the anchoring structure remains inside of the cap when the cap is detached from the first end of the main body to expose the connector plug.

14. The method of claim 13, further comprising:

inserting a printed circuit board assembly (PCBA) of the USB device through a slot opening defined by the connector plug to form a PCBA-connector plug sub-assembly, wherein securing the connector plug to the first end of the casing comprises inserting the PCBA-connector plug sub-assembly into the casing of the main body of the USB device such that the connector plug and the piece of string protrude out of the casing; and snapping on a connector metal case to the connector plug.

15. The method of claim 14, wherein said anchoring structure includes a protruding end tab at a first end of the anchoring structure and a hook at a second end of the anchoring structure, wherein the piece of string is looped over the hook of the anchoring structure.

16. The method of claim 15, further comprising:

inserting the protruding end tab of the anchoring structure into a slot defined on a plate of the connector plug.

17. The method of claim 16, wherein detachably coupling a cap to the first end of the main body comprises:

sliding the cap of the USB device over the anchoring structure and the connector plug such that a recess defined on each of a left side and a right side of the anchoring structure snaps on and mate with a notch on an inner side wall of the cap.

* * * * *